US009121597B2

(12) United States Patent
Snagel et al.

(10) Patent No.: US 9,121,597 B2
(45) Date of Patent: Sep. 1, 2015

(54) LED TRACK LIGHTING SYSTEM

(75) Inventors: Paul Snagel, Chicago, IL (US); Matthew Wnek, Elk Grove Village, IL (US)

(73) Assignee: SCHNEIDER ELECTRIC USA, INC., Palatine, IL (US)

( * ) Notice: Subject to any disclaimer, the term of this patent is extended or adjusted under 35 U.S.C. 154(b) by 1829 days.

(21) Appl. No.: 12/120,364

(22) Filed: May 14, 2008

(65) Prior Publication Data

US 2009/0284988 A1 Nov. 19, 2009

(51) Int. Cl.

| | |
|---|---|
| ***H01R 33/00*** | (2006.01) |
| ***F21V 21/35*** | (2006.01) |
| ***F21S 8/00*** | (2006.01) |
| ***F21V 29/00*** | (2015.01) |
| ***H01R 25/14*** | (2006.01) |
| *F21Y 101/02* | (2006.01) |

(52) U.S. Cl.

CPC ..... *F21V 21/35* (2013.01); *F21S 8/038* (2013.01); *F21V 29/004* (2013.01); *H01R 25/142* (2013.01); *F21Y 2101/02* (2013.01)

(58) Field of Classification Search

CPC ..... F21S 8/038; F21V 21/35; F21V 29/004; F21Y 2101/02; H01R 25/142

USPC ..... 362/648, 659, 249.02, 363, 800, 457, 362/217.1, 217.17

See application file for complete search history.

(56) References Cited

U.S. PATENT DOCUMENTS

| | | | | |
|---|---|---|---|---|
| 5,336,100 | A | 8/1994 | Gabrius et al. | |
| 5,788,518 | A | 8/1998 | Wachter et al. | |
| 6,059,582 | A * | 5/2000 | Tsai | 439/121 |
| 6,079,992 | A * | 6/2000 | Kuchar et al. | 439/122 |
| 6,244,733 | B1 | 6/2001 | Fong et al. | |
| 6,659,623 | B2 * | 12/2003 | Friend | 362/249.06 |
| 6,857,883 | B2 * | 2/2005 | Tang | 439/116 |
| 7,235,754 | B2 * | 6/2007 | Rochon et al. | 200/406 |
| 8,348,492 | B2 | 1/2013 | Mier-Langner et al. | |
| 2003/0011538 | A1 * | 1/2003 | Lys et al. | 345/39 |
| 2004/0033708 | A1 * | 2/2004 | Joseph et al. | 439/110 |
| 2006/0262521 | A1 * | 11/2006 | Piepgras et al. | 362/149 |
| 2007/0285949 | A1 * | 12/2007 | Lodhie et al. | 362/648 |
| 2009/0086492 | A1 * | 4/2009 | Meyer | 362/294 |

OTHER PUBLICATIONS

Radiant LED Lighting Solutions, Linear Low Voltage Lighting, www.ledlightingfactory.com, Ocean, New Jersey, 2006 (9 pages).

* cited by examiner

*Primary Examiner* — Anh Mai
*Assistant Examiner* — Jessica M Apenteng
(74) *Attorney, Agent, or Firm* — Locke Lord LLP

(57) ABSTRACT

A track light assembly includes a low-voltage track. A light module comprises an elongated thermally conductive housing fitted over the track. The housing may also surround the track. The housing preferably forms an elongated channel. An elongated printed circuit board (PCB) is mounted on the thermally conductive housing and carries a plurality of clusters of light emitting diodes (LED's) distributed over the PCB surface. An elongated lens is fitted over the PCB and LED clusters. A track adapter attached to an end portion of the track includes electrically conductive contacts for electrically coupling the conductors in the track housing with contacts on the printed circuit board. Thus, a cool running, elongated, linear light module is provided which is adjustably placeable along the length of the track.

16 Claims, 8 Drawing Sheets

LED TRACK LIGHTING SYSTEM

FIELD OF THE INVENTION

The present invention relates generally to track lighting and, more particularly, to a track lighting system utilizing light-emitting diodes ("LED's") powered by a low-voltage track.

BACKGROUND OF THE INVENTION

As LED lighting becomes more prevalent, there is an increasing need for track lighting systems that can be efficiently manufactured at a low cost, and also can be easily and quickly installed in a manner that provides reliable operation over years of operation.

SUMMARY OF THE INVENTION

One embodiment provides a track light module for use with a low-voltage track carrying a pair of elongated conductors transversely spaced from each other and accessible through a longitudinal slot in the track. The module includes an elongated thermally conductive housing adapted to fit over the track wall that forms the slot. An elongated printed circuit board is mounted on the elongated thermally conductive housing and carries a plurality of clusters of light emitting diodes on a surface of the elongated printed circuit board facing away from the track. The printed circuit board includes a pair of spaced electrically conductive contacts at one end thereof. An elongated lens is fitted over the printed circuit board, and a track adapter attached to an end portion of the elongated thermally conductive housing includes a first pair of electrically conductive contacts for making electrical connections with the conductors in the track housing.

In one implementation, the elongated thermally conductive housing forms an elongated channel having an elongated opening that is closed by the elongated lens. A second pair of electrically conductive contacts electrically couple the first pair of contacts with the contacts on the printed circuit board. Portions of the second pair of contacts preferably form grippers for receiving the printed circuit board end that includes the spaced conductive contacts. The first pair of contacts have first end portions extending through the track slot for engagement with the conductors in the track, and second end portions engaging the second pair of electrically conductive contacts.

When installed on a track, the resulting track lighting assembly comprises a low-voltage track carrying a pair of elongated conductors transversely spaced from each other and accessible through a longitudinal slot in the track, and a light module including an elongated thermally conductive housing fitted over the track wall that forms the slot. An elongated printed circuit board is mounted on the elongated thermally conductive housing and carries a plurality of clusters of light emitting diodes on a surface of the elongated printed circuit board facing away from the track. The printed circuit board includes a pair of spaced electrically conductive contacts at one end thereof. An elongated lens is fitted over the printed circuit, and a track adapter is attached to an end portion of the housing and includes a first pair of electrically conductive contacts for making electrical connections with the conductors in the track housing.

Thus, a cool running, elongated, linear light module is provided which is adjustably placeable along the length of the track.

The foregoing and additional aspects of the present invention will be apparent to those of ordinary skill in the art in view of the detailed description of various embodiments, which is made with reference to the drawings, a brief description of which is provided next.

BRIEF DESCRIPTION OF THE DRAWINGS

The foregoing and other advantages of the invention will become apparent upon reading the following detailed description and upon reference to the drawings.

Figure 1:
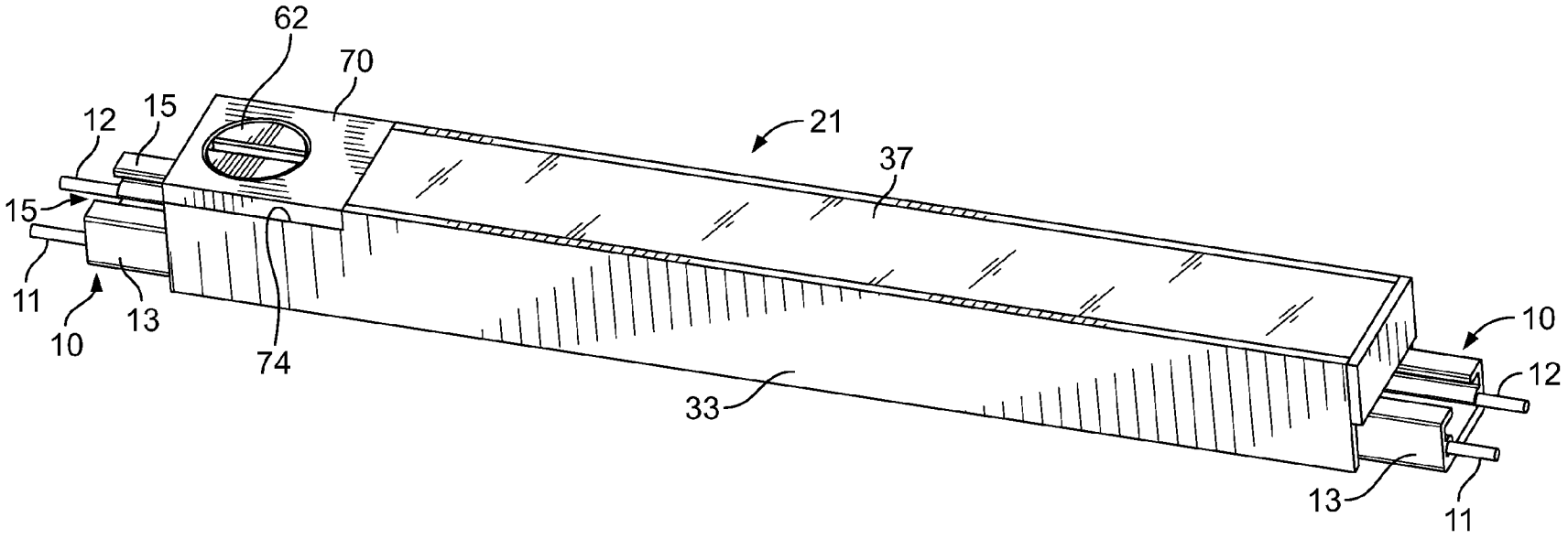
FIG. 1 is a top perspective view of an LED track lighting module installed on a track connected to a low-voltage electrical power source.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE ILLUSTRATED EMBODIMENTS

Although the invention will be described in connection with certain preferred embodiments, it will be understood that the invention is not limited to those particular embodiments. On the contrary, the invention is intended to cover all alternatives, modifications, and equivalent arrangements as may be included within the spirit and scope of the invention as defined by the appended claims.

Turning now to the drawings, a conventional low-voltage track 10 (see FIGS. 1-4 and 7) includes a pair of elongated conductors 11 and 12 connected to a conventional transformer (not shown) that converts 120-volt AC power to a suitable low-voltage power to be distributed by the track 10, such as 12-volt AC power. The elongated, insulating track body 13 is a plastic extrusion having a polygonal cross section with at least three sides, such as the illustrated generally rectangular transverse cross-section forming a hollow interior 14 having two wide sides 14*a*, 14*b* and two narrow sides 14*c*, 14*d*. The hollow interior 14 is open at both ends and also opens through a longitudinal slot 15 that extends along the entire length of the wide side 14*b*. The track 10 is typically mounted on a surface such as a ceiling by conventional fasteners such as molly bolts, passed through holes formed in the solid wall of the housing 13 at intervals along the length of the track.

The power conductors 11 and 12 extend along the length of the track 10 and are held in place by a pair of curved flanges 16 and 17 that terminate near the wide side 14*b* of the hollow interior 14 of the track body 13), to allow access to the conductors at any point along the length of the track 10. This permits light modules to be connected to the conductors 11 and 12 at any desired location along the track 10.

Figure 2:
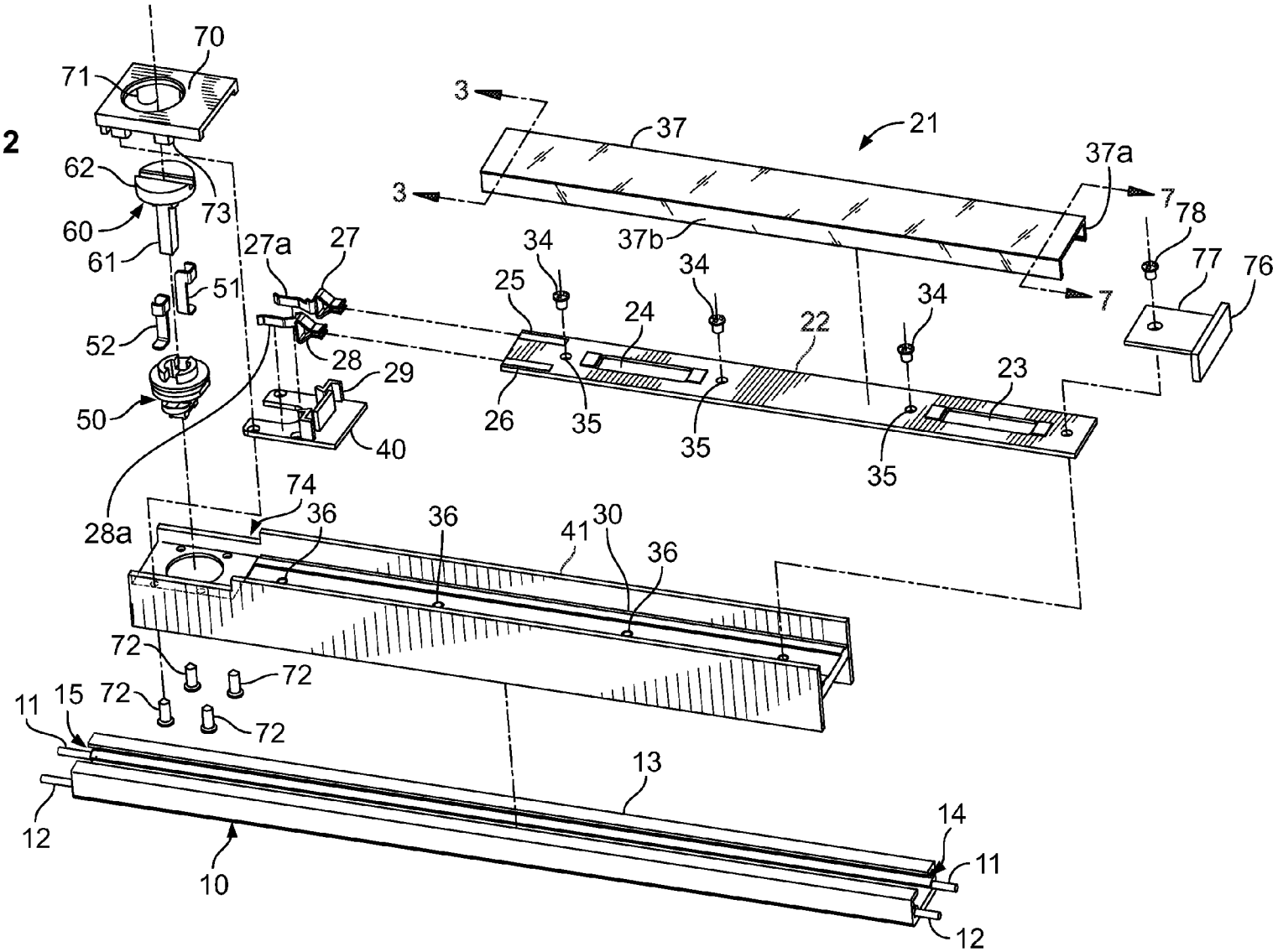
FIG. 2 is an exploded top perspective view of the assembly shown in FIG. 1.

As depicted in FIGS. 1 and 2, an elongated linear light module 21 is attached to the track 10. The light module 21 includes an elongated printed circuit board (PCB) 22 carrying a pair of LED's or LED clusters 23 and 24. As used herein, the term "LED" includes a cluster of light-emitting diodes. The PCB 22 is mounted on a pair of support rails 30 and 31 (FIG. 7) in an elongated channel 32 formed by an elongated thermally conductive (e.g., aluminum) housing 33 that fits over the track 10 and serves as a heat sink to dissipate heat generated by the LED clusters 23 and 24. The housing 33 extends around three sides of the track 10. The bottom of the channel 32 is closed by a solid bottom wall 32*a*, and the top of the channel forms an elongated opening. The PCB 22 is secured to the bottom wall 32*a* of the channel 32 by three screws 34 that pass through spaced holes 35 in the PCB 22 and thread into mating holes 36 in the bottom wall 32*a*. The LED's 23 and 24 face the open side of the channel 32, which opens away from the track 10.

As viewed in FIG. 2, the left-hand end portion of the PCB 22 carries a pair of spaced flat conductors 25 and 26 on the top and bottom surfaces of the PCB 22. The flat conductors 25 and 26 fit into a pair of grippers formed by a first pair of conductive spring contacts 27 and 28 mounted on a supporting structure 29 extending upwardly from the top surface of a U-shaped mounting plate 40 that fits against the left-hand ends of the support rails 30 and 31. As described in more detail below, the spring contacts 27 and 28 connect the PCB 22 to the power conductors 11 and 12 in the track 10. Power is supplied from the contacts 27 and 28 to the conductors 25 and 26 on the PCB 22, and then through any desired circuitry on the PC board to the LED clusters 23 and 24. PCB's of this type are commercially available, e.g., from Lynk Labs Inc. in Elgin, Ill.

Figure 7:
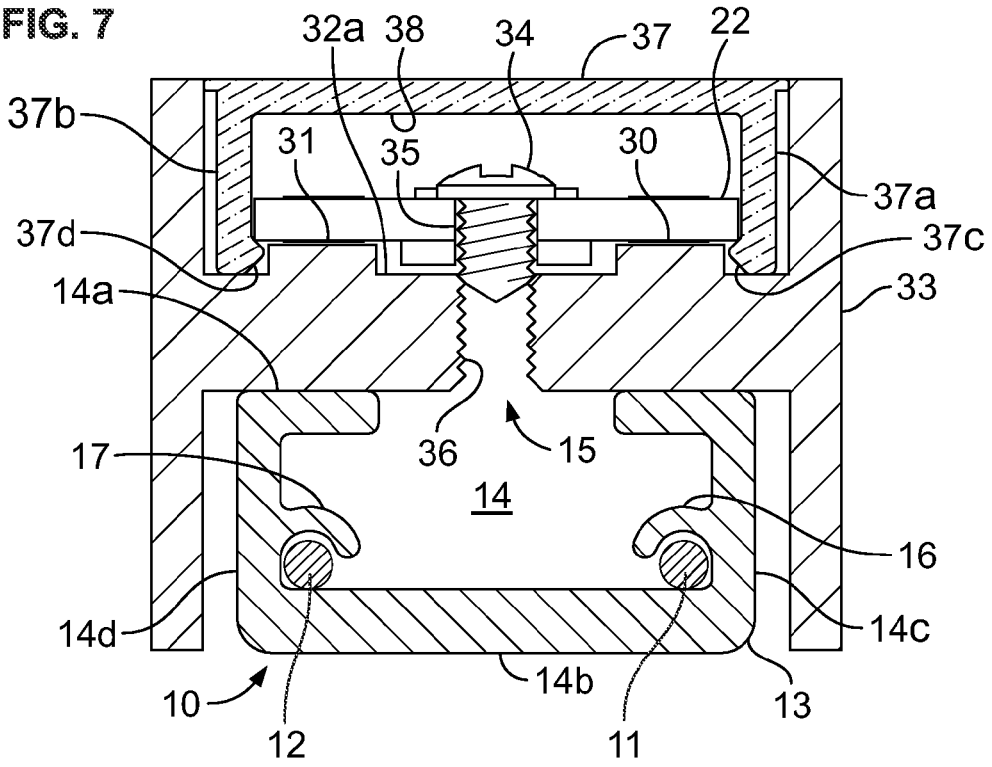
FIG. 7 is an enlarged section taken along line 7-7 in FIG. 2.

The channel 32 is closed by an elongated translucent plastic lens 37 that fits into the top portion of at least a major portion (i.e., 50% or more) of the channel 32, as depicted in FIGS. 1 and 7. As can be seen in FIG. 7, the lower ends of sidewalls 37*a* and 37*b* of the lens 37 rest on the bottom wall 32*a* of the channel 32. Detents 37*c* and 37*d* formed near the lower ends of the inside surfaces of the sidewalls 37*a*, 37*b* snap under the PCB 22 to hold the lens 37 in place within the channel 32. The lens 37 is preferably coated on its inside surface with a phosphor coating 38 to help achieve a desired color temperature of light (e.g., 3000K or 5000K) and diffuse the light emitted for more even distribution.

The first pair of spring contacts 27 and 28 include extensions 27*a* and 28*a* that engage a second pair of spring contacts 51 and 52 captured inside a nonconductive track adapter 50 (see FIGS. 2-6 and 8-10). As can be clearly seen in FIG. 8, the spring contacts 51 and 52 include integral L-shaped legs 53 and 54 that extend downwardly through a central passageway in the adapter 50. When the adapter 50 is attached to the track 10, the legs 53 and 54 extend through the slot of the track, and the tabs 53*a* and 54*a* formed by the lower ends of the legs 53 and 54 make contact with the track conductors 11 and 12. Power can then be supplied from the conductors 11 and 12 through the contacts 51, 52 and 27, 28 to the conductors 25, 26 on the PCB 22, and then through the circuitry on the PCB to the LED clusters 23, 24. The track adapter 50 thus permits the linear light module to be adjustably placed anywhere along the length of the track 10.

Figure 5:
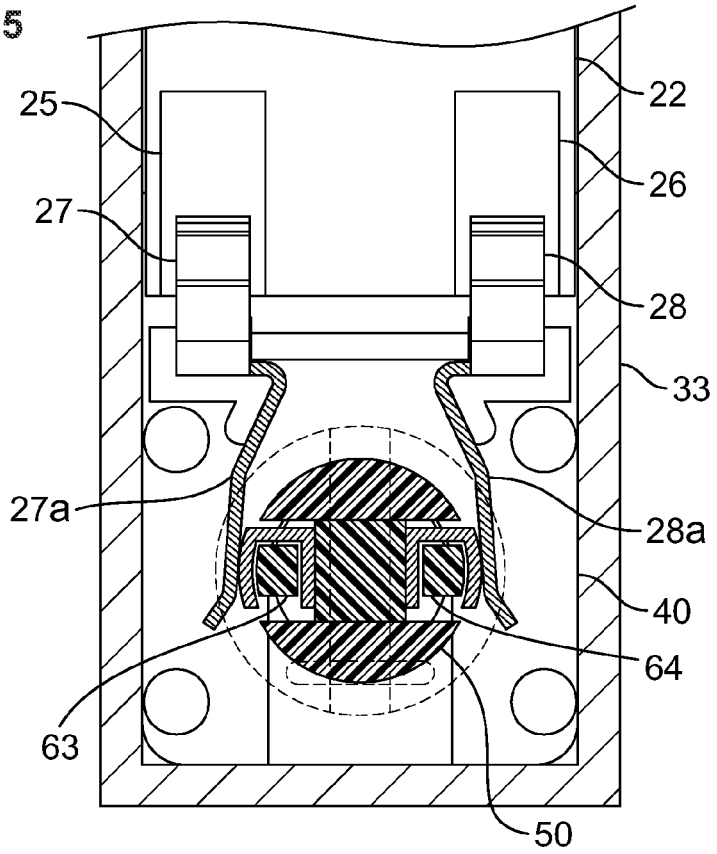
FIG. 5 is a section taken along line 5-5 in FIG. 3.
Figure 6:
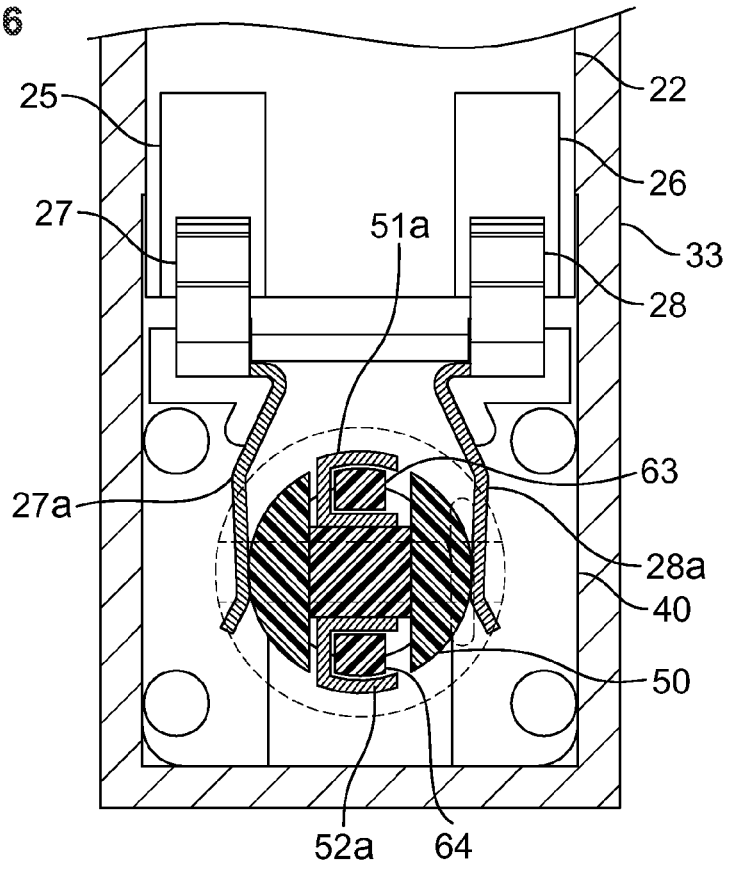
FIG. 6 is a section taken along line 6-6 in FIG. 4.
Figure 8:
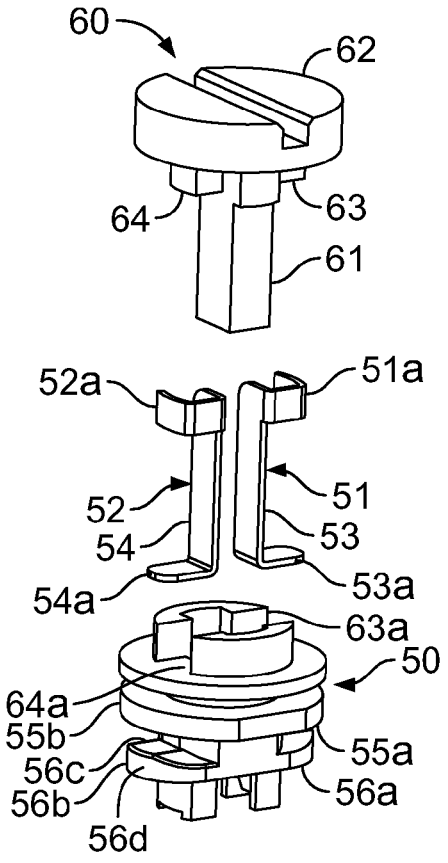
FIG. 8 is an exploded top perspective view of the track adapter and actuator sub-assembly in the lighting module shown in FIGS. 1-6.
Figure 9:
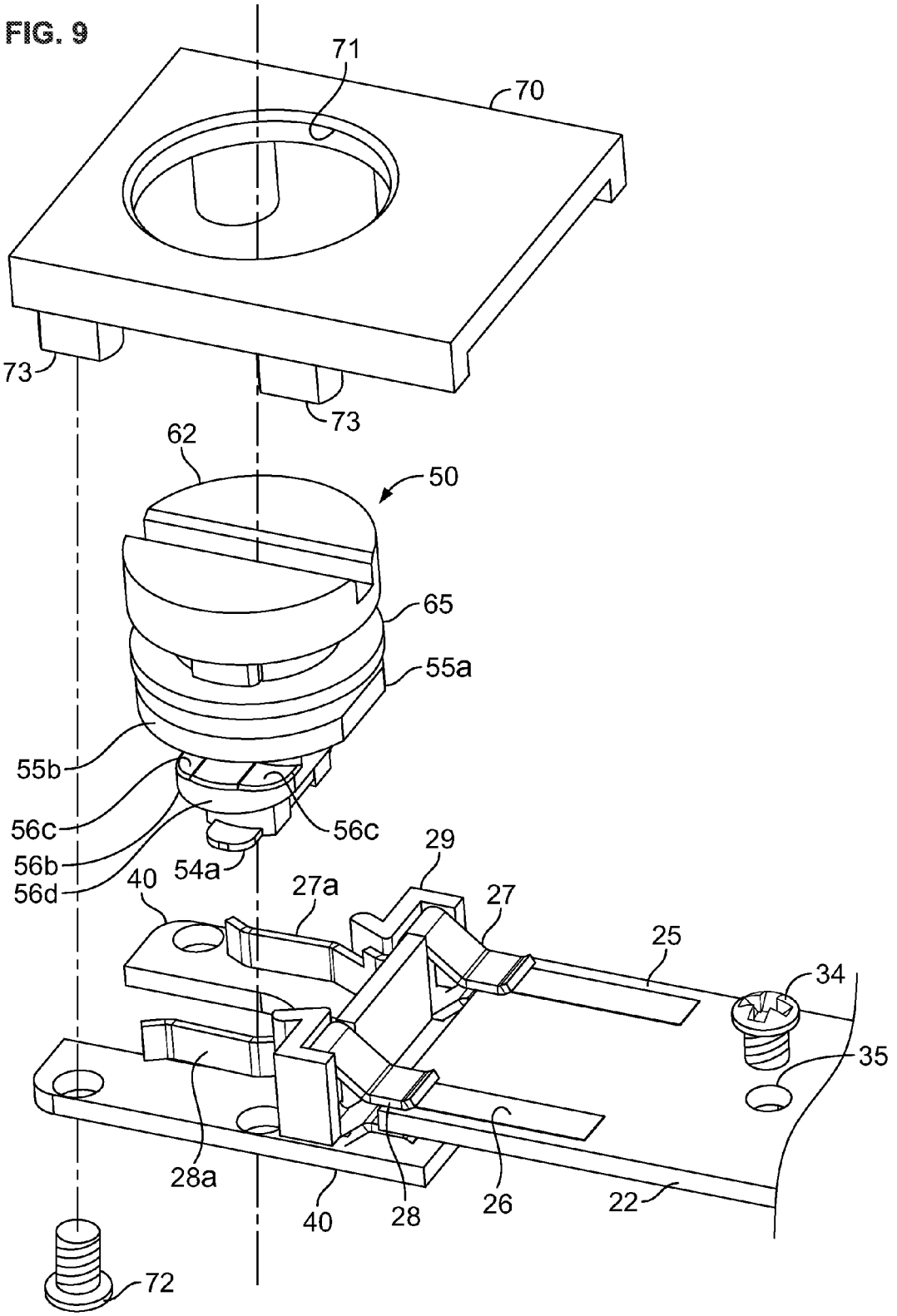
FIG. 9 is an enlarged exploded top perspective of the electrical connection portion of the lighting module shown in FIG. 1, including the track adapter and actuator sub-assembly.
Figure 10:
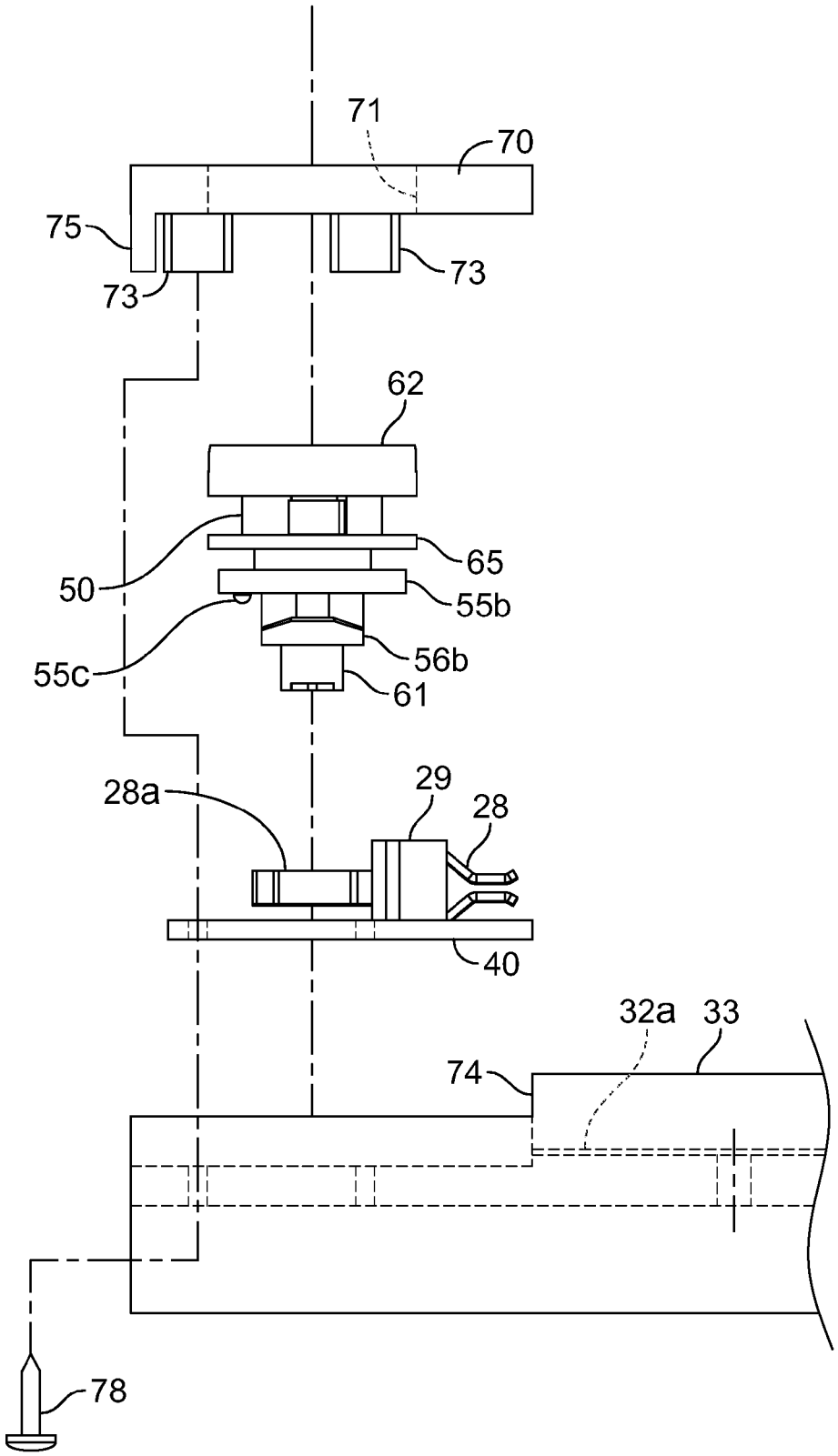
FIG. 10 is an exploded side elevation of the parts shown in FIG. 9 along with the end portion of the housing on which such parts are mounted.

The lower portion of the track adapter 50 forms pairs of flanges 55*a*, 56*a* and 55*b*, 56*b* on opposite sides of the adapter. The flanges 56*a* and 56*b* are narrow enough to fit through the longitudinal slot 15 of the track 10, when the adapter 50 is rotated 90° (around a vertical axis) from the position shown in FIGS. 2, 3, 5 and 9, to the position shown in FIGS. 3 and 6. The adapter 50 is rotated by turning a central actuator 60 that has a square shank 61 extending down through a central passageway formed in the adapter 50, between the two spring contacts 51 and 52 (see FIGS. 2, 5, 6 and 8). The shank 61 holds the two spring contacts 51 and 52 in desired positions within the adapter 50. The upper end of the actuator 60 terminates in an enlarged head 62 that is slotted to facilitate rotating the actuator. As can be seen in FIGS. 5, 6 and 8, a pair of lugs 63 and 64 depend from the head 62 to form anchors for upper end portions 51*a* and 52*a* of the spring contacts 51 and 52, which bend around the anchoring lugs 63 and 64. The lugs 63 and 64 bottom out on a flange 65 formed by the adapter 50.

The space between the two flanges in each pair 55*a*, 56*a* and 55*b*, 56*b* is dimensioned to receive the thickness of the top wall of the track body 13 when the adapter 50 is attached to the track 10. As the adapter 50 is rotated to the position shown in FIGS. 3 and 6, the lower flanges 56*a* and 56*b* slide under the top wall of the track body 13, thereby fastening the adapter 50 to the track 10. Chamfered top surfaces 56*c* on the flanges 56*a* and 56*b* facilitate smooth sliding engagement of those flanges with the lower surface of the top wall of the track 10 (on both sides of the slot 15) during rotation of the adapter 50 relative to the track 10. Similarly, curved end surfaces 56*d* on the flanges 56*a* and 56*b* facilitate smooth sliding engagement of the ends of those flanges with the side walls of the track 10 during rotation of the adapter 50 relative to the track 10.

Figure 3:
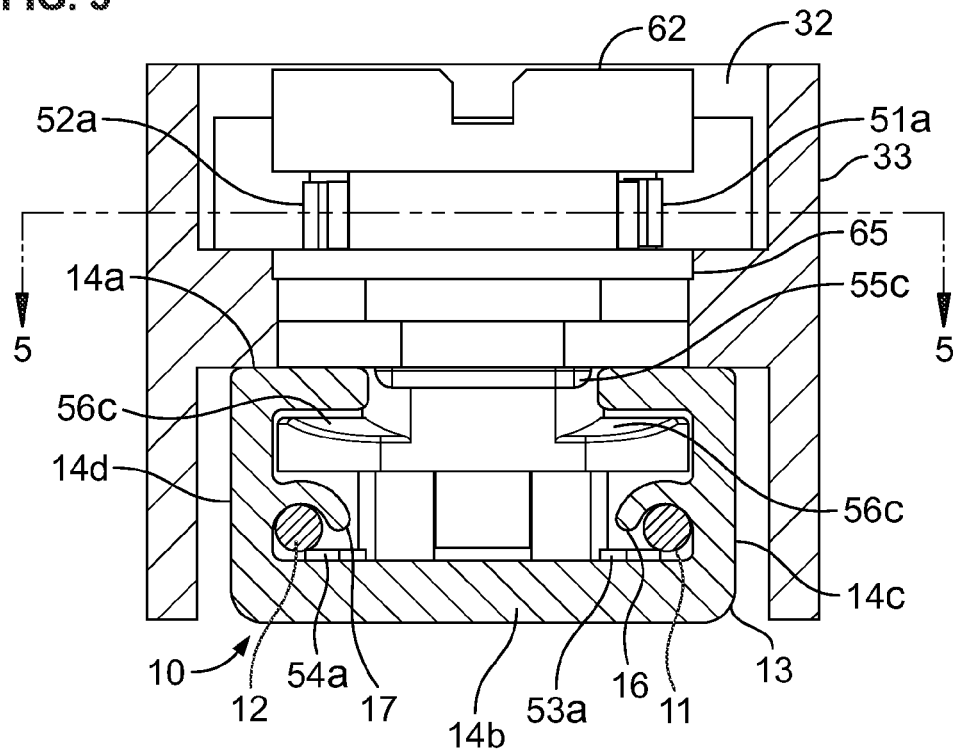
FIG. 3 is an enlarged section taken along line 3-3 in FIG. 2 with the track adapter sub-assembly inserted into the track and attached to the track.
Figure 4:
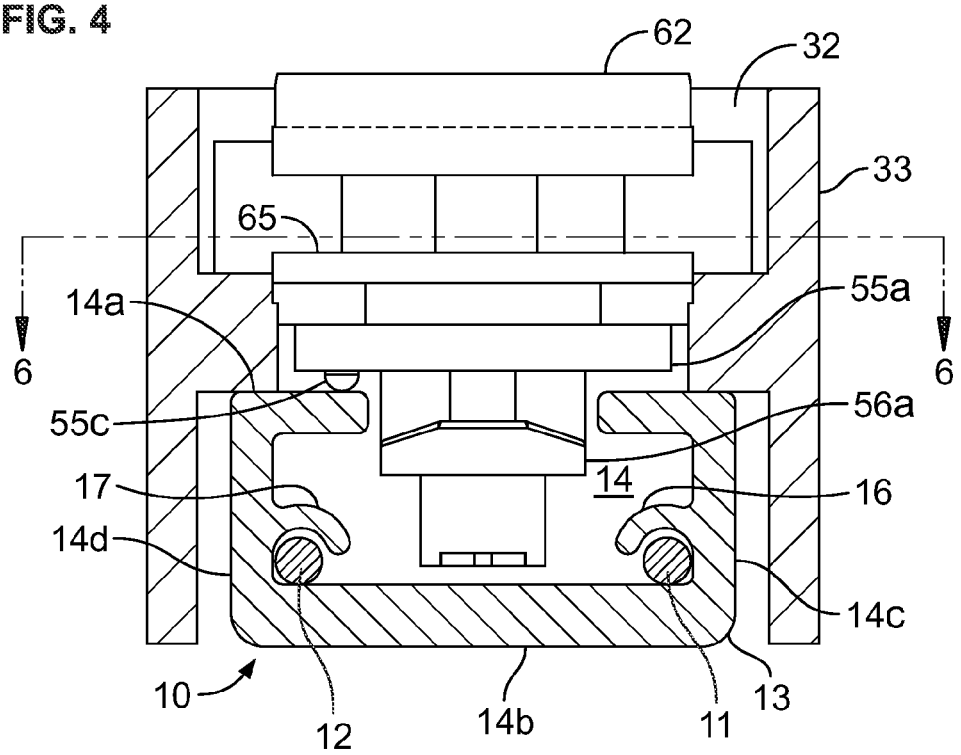
FIG. 4 is the same section shown in FIG. 3 with the track adapter sub-assembly rotated 90 degrees from the position shown in FIG. 3, not attached to the track.

A bead 55*c* (see FIG. 4) on the lower surface of the upper flange 55*a* engages the upper surface of the track 10 to maintain the adapter 50 at a slightly higher elevation during the rotation of the adapter, while the chamfered surfaces of the lower flanges are sliding across the lower surface of the upper wall of the track, and then the bead 55*c* drops into the slot 15 as the 90° rotational movement is completed, as can be seen in FIG. 3.

The same rotational movement that attaches the adapter 50 to the track 10 also brings the tabs 53*a* and 54*a* on the lower ends of the spring contacts 51 and 52 into firm contact with the track conductors 11 and 12. The free ends of the tabbed lower ends of the spring contacts 51 and 52 are curved (see FIG. 8) so that they act as cam surfaces as the rotational movement of the track adapter 50 brings those cam surfaces into engagement with the conductors 11 and 12.

The rotational movement of the adapter 50 described above also brings the upper ends 51*a* and 52*a* of the spring contacts 51 and 52 into firm contact with the extensions 27*a* and 28*a* of the spring contacts 27 and 28 that engage the PCB 22, as shown in FIGS. 5 and 6. Thus, the two pairs of spring contacts 51, 52 and 27, 28 form electrical connections between the power conductors 11, 12 in the track 10 and the surface conductors 25, 26 on the PCB 22, for supplying power to the PCB 22 from the track conductors 11, 12.

The adapter 50 and the actuator 60 are held in place by a first end cap 70 that forms an aperture 71 to provide access to the slotted actuator head 62 (see FIGS. 9 and 10) to permit rotation of the actuator. To secure the first end cap 70 to the housing 33, four screws 72 are passed up through mating holes in the bottom wall of the channel 32 and the mounting plate 40 and threaded into mating holes in four bosses 73 depending from the underside of the end cap 70. The right-hand end of the first end cap 70, as viewed in FIG. 2, engages the left-hand end of the lens 36 (see FIG. 1), and the side walls of the end cap 70 fit into notches 74 formed in the top edges of the side walls of the channel 32. A depending flange 75 on the outboard end of the first end cap 70 extends down to the bottom wall of the channel 32, thereby closing that end of the channel. The opposite end of the channel 32 is closed by a second end cap 76 having a tongue 77 that overlaps a portion of the PCB 22 and is used to attach both the second end cap 76 and the PCB 22 to the housing 33 with a fastening element such as a screw 78 (see FIG. 2). It will be appreciated that a nonconductive adapter embodiment could be used rather than the end cap 76 to provide further securement of the housing 33 to the track 10.

Figure 11:
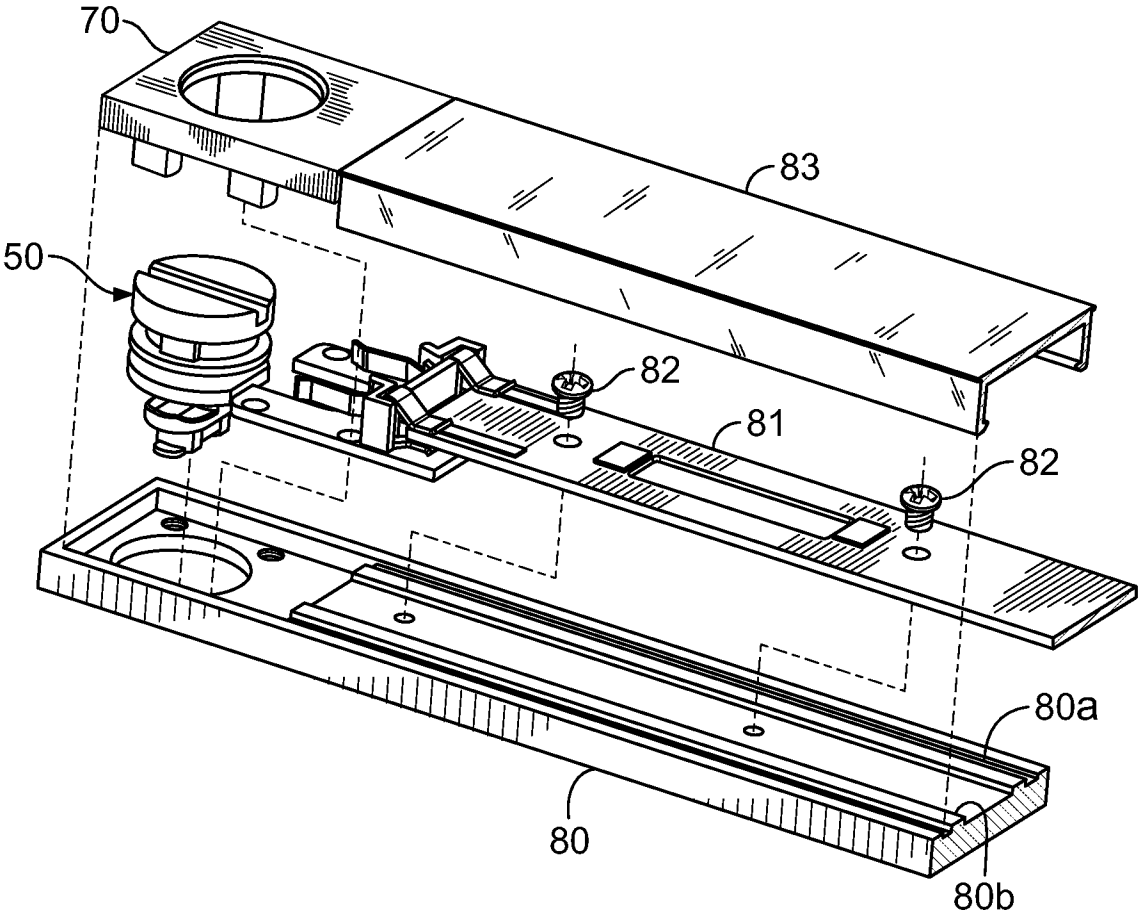
FIG. 11 is an exploded perspective of a modified embodiment of a lighting module, with the right-hand end portion removed to show the cross-sectional shapes of the various parts.

FIG. 11 illustrates a modified lighting module having a thermally conductive housing 80 that has a smaller transverse cross section than the embodiment shown in FIGS. 1-10. Specifically, the lower surface of the housing 80 rests on the slotted surface of the track 10, while the upper surface of the housing 80 forms a pair of rails 80*a* and 80*b* for supporting a printed circuit board 81. The PCB 81 is attached to the housing 80 by multiple screws 82, in the same manner described above for the embodiment of FIGS. 1-10, and is covered by a lens 82 having side walls whose bottom edges snap under the edges of the PCB 81. The left-hand end of this modified light module includes the same adapter 50 and end cap 70 described above in FIGS. 1-10.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

The invention claimed is:

1. A track light assembly comprising a low-voltage, insulating track body having a hollow interior accessible through a longitudinal slot formed by a wall of said track body, and a pair of elongated conductors transversely spaced from each other and extending along a length of said track body through said hollow interior, said conductors being accessible through said longitudinal slot, an elongated thermally conductive housing fitted over the track wall that forms said slot so as to cover said slot along a length of the thermally conductive housing, the thermally conductive housing also serving as a heat sink for a plurality of clusters of light emitting diodes, an elongated printed circuit board mounted on and fastened to a base of said elongated thermally conductive housing and carrying the plurality of clusters of light emitting diodes on a surface of said elongated printed circuit board facing away from said track body, said printed circuit board including a pair of spaced electrically conductive contacts at one end thereof;

a track adapter attached to an end portion of said housing and including a first pair of electrically conductive contacts for making electrical connections with said conductors in said track body and a second pair of electrically conductive contacts for electrically coupling said first pair of contacts with said contacts on said printed circuit board, said second pair of contacts having portions that form grippers for receiving the printed circuit board end that includes said spaced conductive contacts, said first pair of contacts having first end portions extending through said longitudinal slot for engagement with said conductors in said track body and second end portions for engaging said second pair of electrically conductive contacts; and an actuator for rotating said adapter relative to said track body for securing said adapter to said track, said rotating of the adaptor also rotating the first end portions of said first pair of contacts into engagement with said conductors in said track body.

2. The track light assembly of claim 1 in which said elongated thermally conductive housing forms an elongated channel having an elongated opening.

3. The track light assembly of claim 2 which includes an end cap attached to said elongated thermally conductive housing and closing an end of said channel.

4. The track light assembly of claim 3 in which a portion of said end cap overlaps said printed circuit board, and which includes a fastening element securing said overlapping portion of said end cap and said printed circuit board to said housing.

5. The track light assembly of claim 2 which includes an elongated lens covering at least a major portion of said channel.

6. The track light assembly of claim 5 in which said elongated lens includes detents that snap under edges of said printed circuit board for securing said lens to said printed circuit board, and said printed circuit board is secured to said elongated thermally conductive housing.

7. The track light assembly of claim 1 in which said track adapter can extend into the low-voltage track body and includes surfaces for fastening said adapter to said track body when said adapter and said track body are placed relative to each other.

8. The track light assembly of claim 1 in which said elongated thermally conductive housing extends around and surrounds three sides of at least a portion of said length of said track body.

9. The track light assembly of claim 8, wherein the elongated thermally conductive housing is a heat sink made of aluminum.

10. The track light assembly of claim 8, wherein the elongated thermally conductive housing has a generally "H" shaped cross-section.

11. The track light assembly of claim 1 which includes a cover attached to said elongated thermally conductive housing, and capturing said adapter on said housing, said cover including an aperture exposing a portion of said actuator to permit rotation of said actuator.

12. The track light assembly of claim 1 which includes a mounting plate for said second pair of contacts, and fastening elements securing said mounting plate to said elongated thermally conductive housing.

13. The track light assembly of claim 1, wherein the actuator, when actuated, permits the elongated thermally conductive housing and the elongated printed circuit board mounted thereon to be adjustably placed anywhere along the length of said track body.

14. A track light assembly, comprising:

a low-voltage, insulating track body having a hollow interior accessible through a longitudinal slot formed by a wall of said track body, and a pair of elongated conductors transversely spaced from each other and extending along a length of said track body through said hollow interior, said conductors being accessible through said longitudinal slot, an elongated thermally conductive housing fitted over the track wall that forms said slot so as to cover said slot along a length of the thermally conductive housing, the thermally conductive housing also serving as a heat sink for a plurality of clusters of light emitting diodes, an elongated printed circuit board mounted on and fastened to a base of said elongated thermally conductive housing and carrying the plurality of clusters of light emitting diodes on a surface of said elongated printed circuit board facing away from said track body, said printed circuit board including a pair of spaced electrically conductive contacts at one end thereof;

a track adapter attached to an end portion of said housing and including a first pair of electrically conductive contacts for making electrical connections with said conductors in said track body; and a second pair of electrically conductive contacts for electrically coupling said first pair of contacts with said contacts on said printed circuit board, said second pair of contacts having portions that form grippers for receiving the printed circuit board end that includes said spaced conductive contacts, said first pair of contacts having first end portions extending through said longitudinal slot for engagement with said conductors in said track body and second end portions for engaging said second pair of electrically conductive contacts.

15. The track light assembly of claim 14, further comprising a mounting plate for said second pair of contacts, and fastening elements securing said mounting plate to said elongated thermally conductive housing.

16. A track light assembly comprising a low-voltage, insulating track body having a hollow interior accessible through a longitudinal slot formed by a wall of said track body, and a pair of elongated conductors transversely spaced from each other and extending along a length of said track body through said hollow interior, said conductors being accessible through said longitudinal slot, an elongated thermally conductive housing fitted over the track wall that forms said slot so as to cover said slot along a length of the thermally conductive housing, the thermally conductive housing also serving as a heat sink for a plurality of clusters of light emitting diodes, an elongated printed circuit board mounted on and fastened to a base of said elongated thermally conductive housing and carrying the plurality of clusters of light emitting diodes on a surface of said elongated printed circuit board facing away from said track body, said printed circuit board including a pair of spaced electrically conductive contacts at one end thereof; and a track adapter attached to an end portion of said housing and including a first pair of electrically conductive contacts for making electrical connections with said conductors in said track body and a second pair of electrically conductive contacts for electrically coupling said first pair of contacts with said contacts on said printed circuit board, said second pair of contacts having portions that form grippers for receiving the printed circuit board end that includes said spaced conductive contacts, said first pair of contacts having first end portions extending through said longitudinal slot for engagement with said conductors in said track body and second end portions for engaging said second pair of electrically conductive contacts, wherein said track adapter can extend into the low-voltage track and includes surfaces for fastening said adapter to said track when said adapter and said track are placed relative to each other.

* * * * *